US008494433B2

(12) United States Patent
Uchida et al.

(10) Patent No.: US 8,494,433 B2
(45) Date of Patent: Jul. 23, 2013

(54) RECORDING-MEDIUM POSITIONING DEVICE AND IMAGE FORMING APPARATUS EMPLOYING THE DEVICE

(75) Inventors: Takeshi Uchida, Hitachinaka (JP); Kiyomi Tsuchiya, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 439 days.

(21) Appl. No.: 12/457,738

(22) Filed: Jun. 19, 2009

(65) Prior Publication Data

US 2009/0317114 A1 Dec. 24, 2009

(30) Foreign Application Priority Data

Jun. 20, 2008 (JP) ..... 2008-161243

(51) Int. Cl.
*B65H 9/00* (2006.01)
*G03G 21/00* (2006.01)

(52) U.S. Cl.
USPC ..... 399/400; 399/388

(58) Field of Classification Search
USPC ..... 399/400, 33, 68, 122, 388
See application file for complete search history.

(56) References Cited

U.S. PATENT DOCUMENTS

| | | | | |
|---|---|---|---|---|
| 7,880,871 | B2 * | 2/2011 | Kazama et al. | 356/139.04 |
| 2003/0129008 | A1 * | 7/2003 | Seto | 399/388 |
| 2008/0003031 | A1 * | 1/2008 | Tsuchiya et al. | 399/361 |
| 2010/0278551 | A1 * | 11/2010 | Maruko et al. | 399/68 |

FOREIGN PATENT DOCUMENTS

| | | | |
|---|---|---|---|
| JP | 2000092292 | A | 3/2000 |
| JP | 2000-221821 | | 8/2000 |
| JP | 2000-221834 | | 8/2000 |
| JP | 2001354346 | A | 12/2001 |
| JP | 2003131525 | A | 5/2003 |
| JP | 2003131525 | A * | 5/2003 |
| JP | 2005-134795 | | 5/2005 |
| JP | 2006-072246 | | 3/2006 |
| JP | 2007106572 | A | 4/2007 |
| JP | 2008-024507 | | 2/2008 |

OTHER PUBLICATIONS

Japanese Patent Office Notice dated Sep. 4, 2012 for corresponding Japanese Patent Application No. 2008-161243.

* cited by examiner

*Primary Examiner* — Matthew G Marini
*Assistant Examiner* — Ruben Parco, Jr.
(74) *Attorney, Agent, or Firm* — Harness, Dickey & Pierce, P.L.C.

(57) ABSTRACT

A recording-medium positioning device includes a gate, a roller pair, a roller-pair shift unit, a recording-medium detector, and a drive control device. The gate is disposed at an upstream side of a fixing device in a conveyance direction of a recording medium. The roller pair includes two roller members disposed at an upstream side of the gate. The roller-pair shift unit moves the roller pair in accordance with a first position of the recording medium in the conveyance direction to shift the recording medium in a width direction perpendicular to the conveyance direction. The recording-medium detector is disposed between the fixing device and the gate to detect a second position of the recording medium in the width direction. The drive control device moves the recording medium to a reference position by driving the roller-pair shift unit in accordance with the second position and cyclically shifts the reference position.

9 Claims, 12 Drawing Sheets

【DATA】
200 SHEETS/CELL
160 CELLS/AREA
32,000 SHEETS/AREA

SHIFT POSITION : 0.0847mm/POINT

[DATA]
320 SHEETS/CELL
100 CELLS/AREA
32,000 SHEETS/AREA

SHIFT POSITION : 0.0847mm/POINT

[DATA]
128 SHEETS/CELL
250 CELLS/AREA
32,000 SHEETS/AREA

SHIFT POSITION : 0.0847mm/POINT

RECORDING-MEDIUM POSITIONING DEVICE AND IMAGE FORMING APPARATUS EMPLOYING THE DEVICE

CROSS-REFERENCE TO RELATED APPLICATIONS

The present patent application claims priority pursuant to 35 U.S.C. §119 from Japanese Patent Application No. 2008-161243, filed on Jun. 20, 2008 in the Japan Patent Office, the entire contents of which are hereby incorporated herein by reference.

BACKGROUND OF THE INVENTION

1. Field of the Invention

Illustrative embodiments of the present invention relate to a recording-medium positioning device and an image forming apparatus employing the recording-medium positioning device, and more specifically, to a recording-medium positioning device capable of preventing image-fixing failure and a reduction in service life of a fixing member due to damage caused by edge portions of a recording medium, and an image forming apparatus employing the recording-medium positioning device.

2. Description of the Background

Multi-color image forming apparatuses, such as a full-color printer and a spot-color printer, are used as copiers, printers, facsimile machines, plotters, and multi-functional devices combining several of the foregoing capabilities. A conventional color image forming apparatus includes a plurality of photoconductive drums arranged in tandem in a travel direction of an endless intermediate transfer belt. When electrostatic latent images are formed on the photoconductive drums, different color toners are adhered to the electrostatic latent images to form toner images on the photoconductive drums. The toner images on the photoconductive drums are transferred in turn onto a transfer belt.

Such a conventional image forming apparatus feeds a sheet from a sheet feed unit, conveys the sheet toward a transfer position of the toner image, temporarily stops the sheet with a pair of registration rollers located on an upstream side of the transfer position in a direction (hereinafter, a "sheet conveyance direction") in which the sheet is conveyed, and drives the pair of registration rollers to feed the sheet to the transfer position in sync with the toner image conveyed on the transfer belt.

In such a conventional image forming apparatus, in order to align the print-start positions of a conveyed sheet and an image in a sheet width direction perpendicular to the sheet conveyance direction, a shift mechanism is provided at an upstream side of a pair of registration rollers to shift the sheet in the sheet width direction within a sheet placement area. When the print start positions of the sheet and the image are aligned, the conventional image forming apparatus feeds the sheet to a transfer position with the pair of registration rollers to transfer the image onto the sheet at the transfer position.

The sheet having the transferred image is conveyed to a fixing device and pressed and heated with a fixing member. In the fixing device, a sheet conveyance line is invariably maintained. However, after a number of sheets of identical width is fixed, certain portions of the fixing member experience wear due to repeated contact with edges of the sheets. Such worn portions may degrade the quality of an image fixed on the sheet or reduce the service life of the fixing member.

To extend the service life of the fixing member, one conventional, image forming apparatus includes a plurality of fixing devices arranged in tandem or parallel (one to another) in a sheet conveyance direction, and switches the plurality of fixing devices to perform fixing operation. However, such an arrangement involving a plurality of fixing devices is not advantageous in terms of size reduction of the image forming apparatus.

Alternatively, to suppress wear of such a fixing member by edge portions of a recording medium, another conventional image forming apparatus includes an entry-position shift unit at an upstream side of a fixing device. The entry-position shift unit shifts an entry position, at which the recording medium entries a nip portion of a fixing member, in a direction perpendicular to a sheet conveyance direction.

However, since the width of a sheet conveyance line shifted by the entry-position shift unit is a fixed value, the recording medium invariably passes several specific, fixed portions of the fixing member. Consequently, after a number of recording media passes the fixing device, these specific fixed portions of the fixing member experience wear due to repeated contact with edges of the recording media, degrading image quality at the specific worn portions.

FIGS. 11A to 11E illustrates conveyance of a sheet P using the above-described conventional entry-position shift unit. The sheet P is conveyed from a sheet-feed cassette to a conveyance belt 28 along a center line of the conveyance belt 28, which is driven by a belt drive motor 68, not shown. At this time, the sheet P is on a conveyance guide 32, and is conveyed by conveyance sub-belts 28A and 28B rotating at the same speed, as shown in FIG. 11A. As illustrated in FIG. 11B, when the rotation speed V1 of the belt drive motor 68 slows down, the rotation speed V2 of the conveyance sub-belt 28B becomes faster than the rotation speed of the conveyance sub-belt 28A. As a result, as illustrated in FIG. 11C, the, conveyance speed of the right side of the sheet P becomes faster than the conveyance speed of the left side of the sheet P, and therefore-the sheet P is tilted with respect to the conveyance direction of the sheet P and shifted toward the left side, as shown in FIG. 11C. As a result, the sheet P is conveyed with an edge portion of the sheet P abutted against a guide rib 32H as illustrated in FIG. 11D. In such a case, the sheet conveyance line varies depending on the size, type,.and thickness of sheet, causing a plurality of worn portions in end portions "Z" of the fixing member, as shown in FIG. 11E.

Such worn portions cause uneven fixing at the end portions "Z"of the fixing member, resulting in uneven image quality. FIGS. 12A and 12B illustrate such worn states of a fixing member in the related art. FIG. 12A illustrates an example of a worn portion 111 observed when one sheet passes a fixing member 110. FIG. 12B illustrates a worn state observed when a number of sheets passes the fixing member 110. In FIG. 12B, two worn portions 111 and 112 arise in the fixing member 110. When an image is fixed with the fixing member 110 in such a state, the worn portions 111 and 112 may cause uneven fixing, resulting in uneven image quality.

SUMMARY OF THE INVENTION

The present disclosure provides an image forming apparatus capable of suppressing wear on a fixing member caused by edge portions of a recording medium and preventing degradation in image quality due to such wear.

In one illustrative embodiment, a recording-medium positioning device includes a gate, a roller pair, a roller-pair shift unit, a recording-medium detector, and a drive control device. The gate is disposed at an upstream side of a fixing device in a conveyance direction of a recording medium on a conveyance path and is movable between an open position to allow the recording medium to pass and a closed position to position the recording medium by abutting the recording medium against the gate. The roller pair includes two roller members disposed at an upstream side of the gate. The roller members sandwich the recording medium on the conveyance path in a thickness direction of the recording medium and are movable between a contact position to feed the recording medium and a separation position to separate from the recording medium. The roller-pair shift unit moves the roller pair in accordance with a first position of the recording medium in the conveyance direction to shift the recording medium in a width direction of the recording medium perpendicular to the conveyance direction of the recording medium. The recording-medium detector is disposed between the fixing device and the gate and detects a second position of the recording medium in the width direction of the recording medium. The drive control device moves the recording medium to a reference position by driving the roller-pair shift unit in accordance with the second position detected by the recording-medium detector and cyclically shifts the reference position in accordance with an instruction from an upper-level device.

In another illustrative embodiment, an image forming apparatus includes a fixing device and a recording-medium positioning device. The fixing device is disposed on a conveyance path of a recording medium to fix an image on the recording medium. The recording-medium positioning device is disposed at an upstream side of the fixing device in a conveyance direction of the recording medium on the conveyance path. The recording-medium positioning device includes a gate, a roller pair, a roller-pair shift unit, a recording-medium detector, and a drive control device. The gate is disposed at the upstream side of the fixing device in the conveyance direction of the recording medium on the conveyance path and is movable between an open position to allow the recording medium to pass and a closed position to position the recording medium by abutting the recording medium against the gate. The roller pair includes two roller members disposed at an upstream side of the gate. The roller members sandwich the recording medium on the conveyance path in a thickness direction of the recording medium and are movable between a contact position to feed the recording medium and a separation position to separate from the recording medium. The roller-pair shift unit moves the roller pair in accordance with a first position of the recording medium in the conveyance direction to shift the recording medium in a width direction of the recording medium perpendicular to the conveyance direction of the recording medium. The recording-medium detector is disposed between the fixing device and the gate and detects a second position of the recording medium in the width direction of the recording medium. The drive control device moves the recording medium to a reference position by driving the roller-pair shift unit in accordance with the second position detected by the recording-medium detector and cyclically shifts the reference position in accordance with an instruction from an upper-level device.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
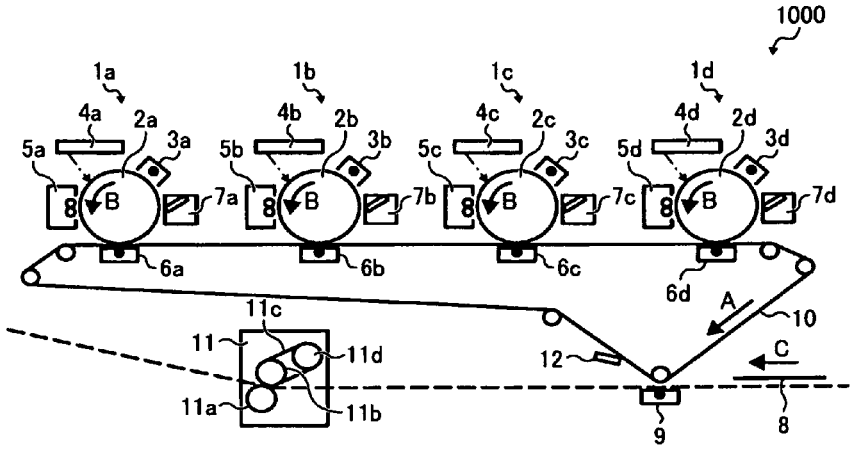
FIG. 1 is a schematic view illustrating a configuration of an image forming apparatus according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be-understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments are described with reference to the drawings.

First, to facilitate understanding of the disclosure, structure and operation of an image forming apparatus 1000 according to illustrative embodiments are described with reference to FIG. 1.

FIG. 1 is a schematic view illustrating a configuration of the image forming apparatus 1000. Below, the image forming apparatus 1000 is described as a color image forming apparatus using four colors of toner. However, it, is to be noted that the image forming apparatus according to the invention is not limited to the color image forming apparatus and may be any suitable type of image forming apparatus employing a fixing device.

In FIG. 1, the image forming apparatus 1000 includes four image-forming units 1*a*, 1*b*, 1*c*, and 1*d* aligned along a transfer belt 10. The image forming unit 1*a* further includes a photoconductive drum 2*a* serving as an image carrier, a drum charger 3*a*, an exposure device 4*a*, a developing device 5*a*, a transfer device 6*a*, and a cleaning device 7*a*. The other image forming units 1*b*, 1*c*, and 1*d* have a configuration identical or substantially similar to the image forming unit 1*a*, differing only in the color of the image they form. For example, the image forming units 1*a*, 1*b*, 1*c*, and 1*d* form color images of yellow, magenta, cyan, and black, respectively.

Upon receiving a start instruction signal of image formation from a printer control device, not shown, the photoconductive drum 2*a* starts to rotate in a direction indicated by an arrow B illustrated in FIG. 1 and continues to rotate until the image formation is finished. When the photoconductive drum 2*a* starts to rotate, a high voltage is supplied to the charger 3*a* and the surface of the photoconductive drum 2*a* is uniformly charged with a negative charge.

When text or graphic data converted to dot image data is transmitted as on/off signals of the exposure device 4*a* from the printer control device to the image forming apparatus 1000, a first portion illuminated with laser light from the exposure device 4*a* and a second portion not illuminated with the laser light are formed on the surface of the photoconductive drum 2*a*. At this time, the charge amount of the first portion is reduced by the laser light of the exposure device 4*a*. When the first portion reaches a position facing the developing device 5*a*, negatively-charged toner particles are attracted onto the first portion of the photoconductive drum 2*a* to form a first toner image.

When the first toner image on the photoconductive drum 2*a* reaches the transfer device 6*a* serving as a primary transfer unit, the first toner image is transferred onto the transfer belt 10 that rotates in the direction indicated by arrow A by action of a high voltage supplied to the transfer device 6*a*. After the first toner image passes a primary transfer position (image transfer portion), residual toner remaining on the photoconductive drum 2*a* is removed by the cleaning device 7*a* in preparation for a subsequent image formation.

Following the image forming unit 1*a*, the image forming unit 1*b* performs image formation in a similar manner, and a second toner image formed on the photoconductive drum 2*b* is transferred onto the transfer belt 10 by action of a high voltage supplied to the transfer device 6*b*.

At this time, the timing at which the first toner image transferred from the image forming unit 1*a* onto the transfer belt 10 reaches the transfer device 6*b* is adjusted so as to match the timing at which the second toner image formed on the photoconductive drum 2*b* is transferred onto the transfer belt 10. Thus, the second toner image formed with the image forming unit 1*b* overlaps the first toner image formed with the image forming unit 1*a* on the transfer belt 10.

Likewise, toner images formed on the image forming units 1*c* and 1*d* are superposed one on another on the first and second toner images to form a full-color toner image on the transfer belt 10.

A sheet feed unit, not shown, of the image forming apparatus 1000 feeds a sheet 8 in a direction indicated by arrow C so that the sheet 8 arrives at the sheet feed device 9 serving as a secondary transfer unit at the same time as the full-color image on the transfer belt 10 does. Then, the full-color toner image is transferred onto the sheet 8 by action of a high voltage supplied to the sheet transfer device 9. The sheet 8 is then conveyed to a fixing device 11, which includes a heating drum 11*a*, a pressure drum 11*b*, a fixing belt 11*c*, and a conversion roller 11*d*. The fixing device 11 melts and fixes the full-color toner image onto the sheet 8.

Meanwhile, after the full-color image passes the sheet transfer device 9, residual toner remaining on the transfer belt 10 is removed by a belt cleaner 12.

Next, a description is given of a recording-medium positioning device 200 according to an illustrative embodiment.

Figure 2A:
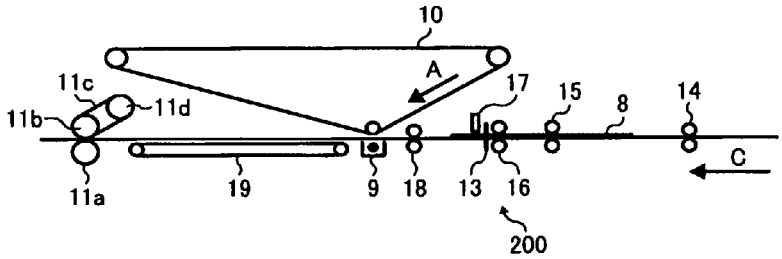
FIGS. 2A is a schematic view illustrating a configuration of a recording-medium positioning device according to an illustrative embodiment of the present disclosure.
Figure 2B:
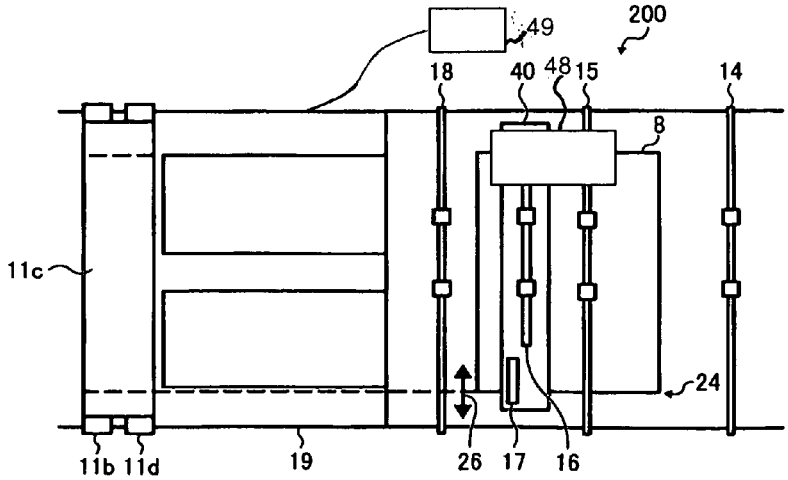
FIG. 2B is a plan view illustrating the recording-medium positioning device of FIG. 2A.

FIGS. 2A and 2B illustrate a configuration of the recording-medium positioning device 200. In FIGS. 2A and 2B, the recording-medium positioning device 200 includes a gate 13 to position a front end of the sheet 8 by abutting the sheet 8 against the gate 13, and a pair of conveyance rollers 15 and a pair of registration rollers 16 located upstream from the gate 13 in a sheet conveyance direction of the sheet 8. The recording-medium positioning device 200 also includes a sheet detector 17, a timing roller 18, and a conveyance belt 19 that are located downstream from the gate 13 in the sheet conveyance direction.

A shift unit 40 serves as a roller driving unit. Within the shift unit 40 are located the gate 13 and the pair of registration rollers 16. The pair of registration rollers 16 is mounted in the shift unit 40 so as to be movable in a recording-medium width direction 26 that is perpendicular to the sheet conveyance direction.

The gate 13 is movable between an open position that allows the sheet 8 to pass below the gate 13 and a closed position at which the sheet 8 is positioned by abutting the sheet 8 against the gate 13. Each of the pair of registration rollers 16 and the pair of conveyance rollers 15 includes two roller members rotated and separated by a driving device. The two roller members sandwich the sheet 8 on a conveyance path in the thickness direction, and move between a contact position to feed the sheet 8 and a separation position to separate from the sheet 8. In the present illustrative embodiment, when the pair of registration rollers 16 is separated from the sheet 8, the gate 13 is closed.

The sheet detector 17 is a detector that detects the location of a recording medium and is disposed between the gate 13 and the sheet transfer device 9 downstream from the gate 13 in the sheet conveyance direction. The sheet detector 17 detects displacement of the sheet 8 in a sheet (recording-medium) width direction perpendicular to the sheet conveyance direction. The shift unit 40 is driven to align an edge of the sheet 8 to a reference position 24. As described below, the reference position 24 is cyclically shifted in accordance with an instruction from an upper-level device 49, preventing uneven wear on the fixing device.

Using the pair of conveyance rollers 15, the sheet 8 from the sheet feeder is conveyed to the gate 13 at a certain speed V1 in the direction indicated by the arrow C. When the sheet 8 is abutted against the gate 13, a rear end portion of the sheet 8 abutted against the gate 13 is fed (overfed) with the pair of conveyance rollers 15 toward the downstream side, bending the sheet 8. Such overfeed corrects a skew of the front end of the sheet 8. In such as state, the pair of registration rollers 16 is closed to press the sheet 8, and the front end of the sheet 8 is positioned at the gate 13.

When the gate 13 is opened to move away from the conveyance path and the pair of conveyance rollers 15 is separated, the sheet 8 resumes its normal linear shape. Thus, positional displacement of the sheet 8 at the upstream side of the pair of registration rollers 16 is also corrected.

In sync with a toner image conveyed by the transfer belt 10, the pair of registration rollers 16 feeds the sheet 8 at a certain speed in the direction indicated by the arrow C so that the arrival of a front edge of the toner image on the transfer belt 10 in the belt rotation direction is timed to coincide with the arrival of a certain position of a front end portion of the sheet 8.

Figure 3A:
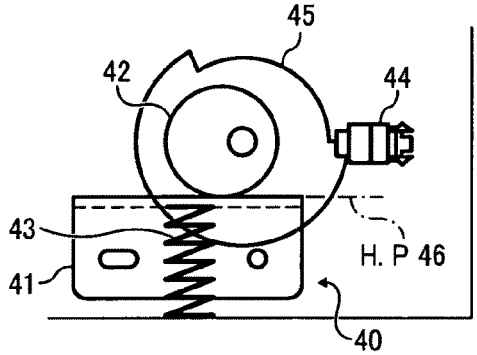
FIGS. 3A to 3C are schematic views illustrating a configuration and operation of a shift unit.
Figure 3B:
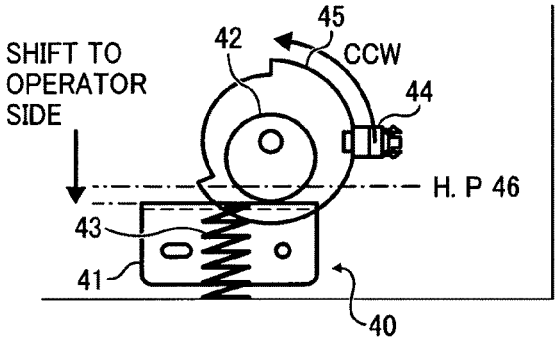
Figure 3C:
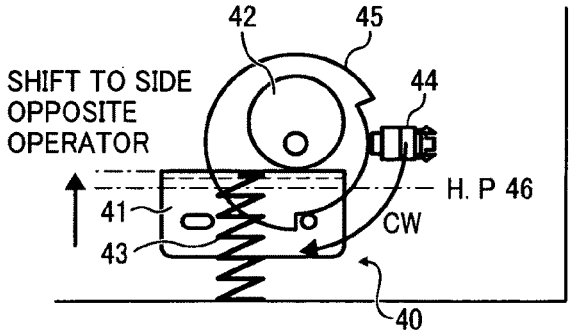

Next, the shift unit 40 is described in detail. FIGS. 3A-3C are diagrams illustrating structure and operation of the shift unit 40. The shift unit 40 includes a base 41 provided with the pair of registration rollers, 16, a cam 42 rotated by a driving device, a spring 43 that presses the base 41 against the cam 42, a cam position detector 44 that detects a rotational position of the cam 42, and a rotatable position detection member 45 attached to the cam 42 and including a cut-out portion detected with the cam position detector 44.

In accordance with a difference between the position of an edge portion of the sheet 8 detected with the sheet detector 17 and the reference position 24for sheet conveyance, the cam 42 is rotated in a clockwise (CW) direction (see FIG. 3C) or a counter-clockwise (CCW) direction (see FIG. 3B) to move the base 41 from a home position (HP) 46 toward either an operator side or a side opposite the operator side in the recording-medium width direction 26 perpendicular to the conveyance direction of the sheet 8.

In the present illustrative embodiment, a drive control device 48 drives the driving device for the cam 42 in accordance with a signal from the sheet detector 17 to move the shift unit 40 and moves the pair of registration rollers 16 in accordance with a shift instruction from an upper-level device 49 to cyclically shift the reference position 24 in the recording-medium width direction 26. The shift instruction from the upper-level device 49 is input to the exposure devices 4*a*, 4*b*, 4*c*, and 4*d* as well as the drive control device 48. The exposure devices 4*a*, 4*b*, 4*c*, and 4*d* shift the exposure positions of the photoconductive drums 2*a*, 2*b*, 2*c*, and 2*d*, respectively, by an amount equal to an amount of shift (to be described later) of the sheet 8 in the recording-medium width direction 26. Thus, image formation is performed in accordance with a certain reference position on a recording medium.

Figure 4:
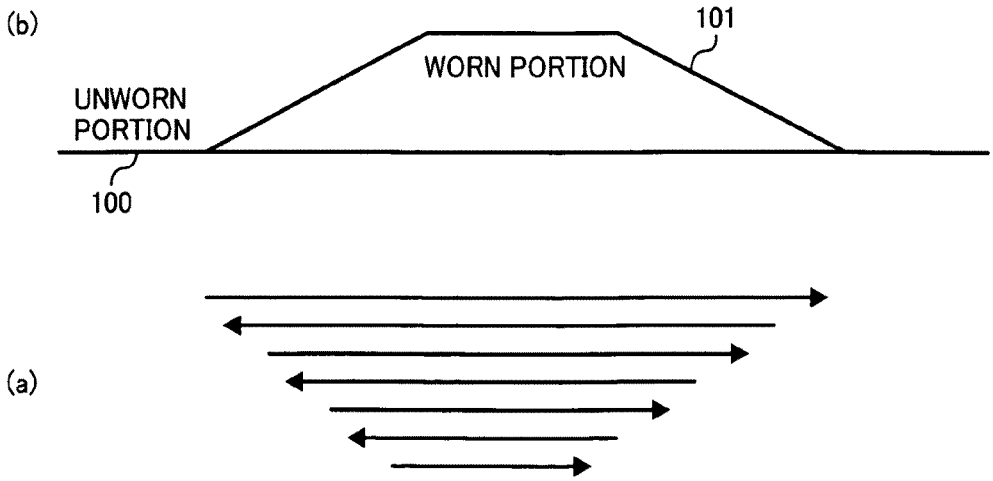
FIG. 4 is a diagram illustrating a first shift pattern and a worn state of a fixing member.
Figure 5:
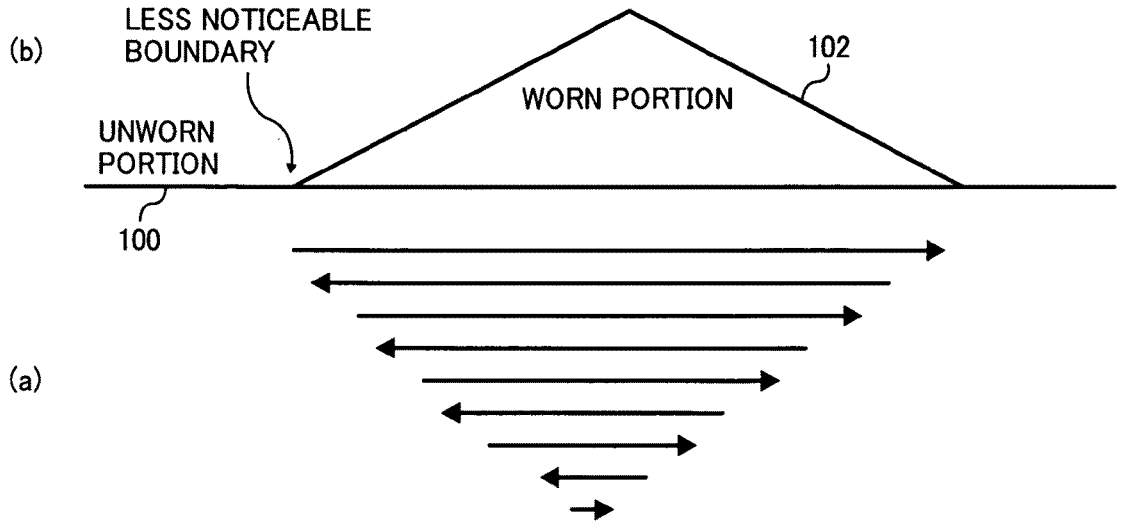
FIG. 5 is a diagram illustrating a second shift pattern and a worn state of a fixing member.
Figure 6:
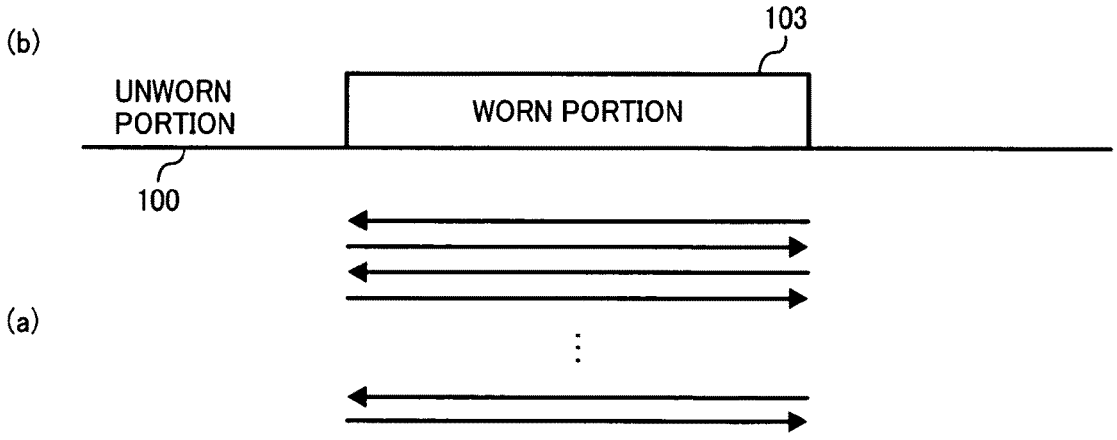
FIG. 6 is a diagram illustrating a third shift pattern and a worn state of a fixing member.

Next, a description is given of shift patterns of the reference position 24. In the present illustrative embodiment, by shifting the reference position 24 each time a certain number of sheets passes the fixing device, worn portions of the fixing member are dispersed to reduce unfavorable effects on the fixing operation due to uneven wear on the fixing member. A plurality of different types of shift-patterns can be set. FIGS. 4 to 6 illustrates shift patterns of the reference position 24. FIGS. 4(*a*), 5(*a*), and 6(*a*) schematically illustrate shift patterns, and FIGS. 4(*b*), 5(*b*), and 6(*b*) schematically illustrate worn states of a fixing member 100.

In a first example, the reference position 24 is shifted in accordance with a shift pattern in which the shift width of the reference position 24 is gradually reduced to a certain width as illustrated in FIG. 4(*a*). In such a case, the number of times an edge portion of the sheet 8 passes a given area of the fixing member 100 decreases at a portion closer to an edge of the given area compared to a middle portion of the given area. As a result, a worn portion 101 is formed in a substantially trapezoidal shape as illustrated in FIG. 4(*b*). Accordingly, in this example, the boundary between the worn portion 101 and an unworn portion is less remarkable, and a narrow edge portion of the substantially-trapezoidal worn portion 101 is not so severely worn. Thus, formation of a step between the narrow edge and each oblique edge can be suppressed, preventing uneven fixing of a desired image.

In a second example, the reference position 24 is shifted in accordance with a shift pattern in which the shift width of the reference position 24 is gradually reduced to a certain width as illustrated in FIG. 5(*a*). In such a case, the number of times an edge portion of the sheet 8 passes a given area of the fixing member 100 decreases at a portion closer to an edge of the given area compared to a middle portion of the given area. As a result, a worn portion 102 is formed in a substantially triangle shape as illustrated in FIG. 5(*b*). Accordingly, in this example, the boundary between the worn portion 101 and an unworn portion is less remarkable and, since the number of times the end portion of the sheet 8 passes the given area of the fixing member 100 increases at a portion around a peak of the substantially-triangular worn portion 102, results in relatively heavy wear near the peak.

In a third example, the reference position 24 is repeatedly shifted with a certain width. In such a case, since an edge portion of the sheet 8 evenly passes a given area of the fixing member 100, a worn portion 103 is formed in a substantially rectangular shape as illustrated in FIG. 6(*b*). In this example, the degree of wear is suppressed as a whole although the boundary between the worn portion 103 and an unworn portion is relatively sharply defined compared to the above-described examples.

In the present illustrative embodiment, the shift pattern in which the shift unit 40 is driven can be selected from among a plurality of different shift patterns, such as the above-described shift patterns, depending on the configuration of the image forming apparatus 1000 and the conditions under which it is used.

Next, the above-described shift patterns are described in detail.

Figure 7A:
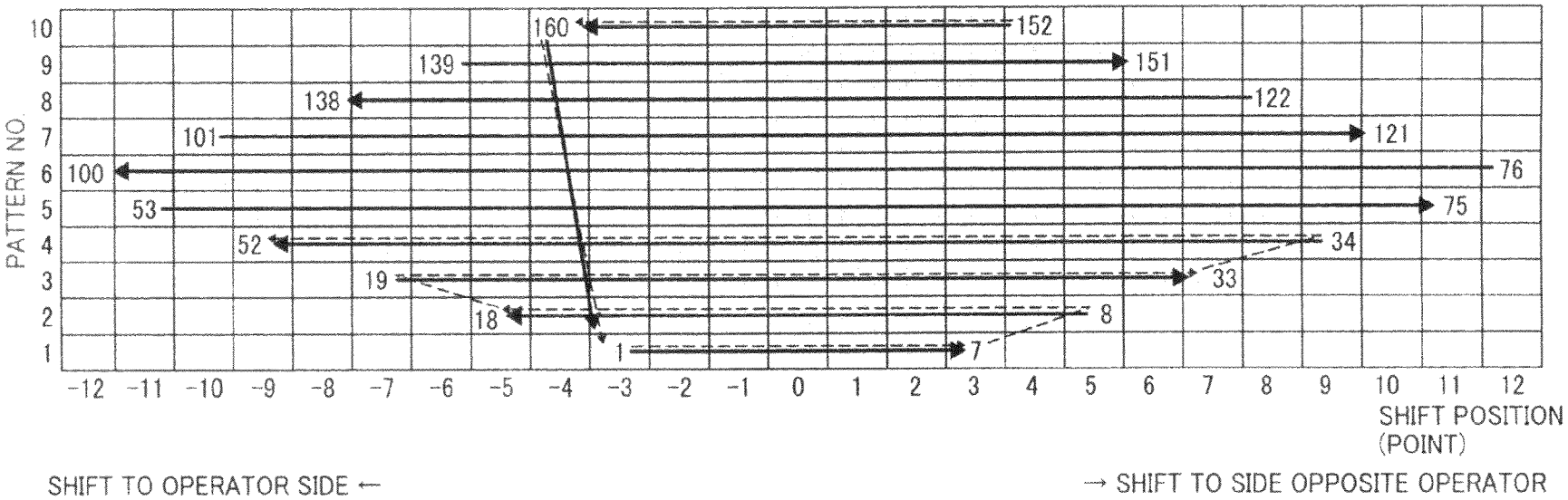
FIG. 7A is a schematic diagram illustrating the first shift pattern illustrated in FIG. 4.
Figure 7B:
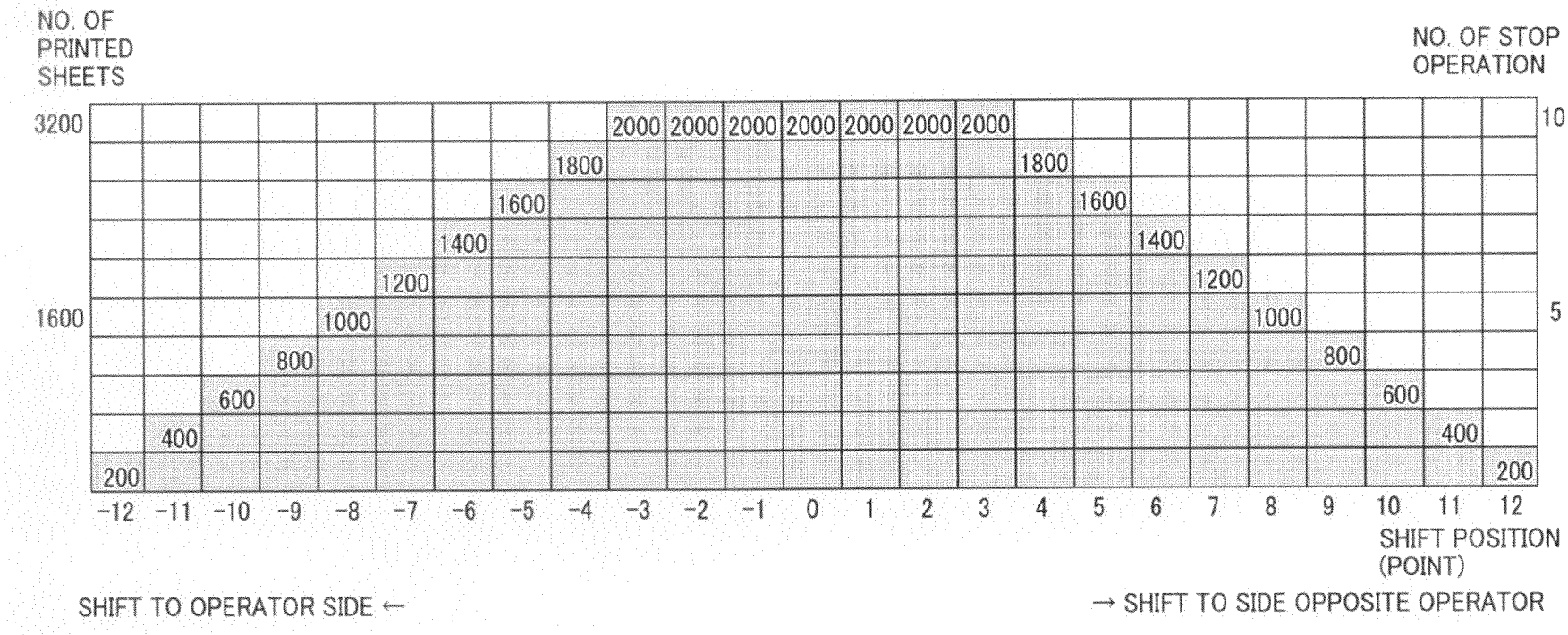
FIG. 7B is a schematic diagram illustrating the number of printed sheets at each shift position.

FIGS. 7A and 7B illustrate the first shift pattern. FIG. 7A is a schematic diagram illustrating the first shift pattern, and FIG. 7B is a schematic diagram illustrating the number of printed sheets at each shift position.

In this example, a worn portion is formed in a substantially trapezoidal shape as illustrated in FIG. 4(*a*), and the first shift pattern includes a set of 10 patterns (pattern 1 to 10). In the first shift pattern, from a neutral position "0" of the reference position 24, the reference position 24 is shifted in positive and negative directions according to, for example, the following patterns 1 to 10. In this example, the negative direction indicates an operator side, and the positive direction indicates a side opposite the operator side.

Pattern 1: 7 points from the position "−3" to the position "+3" (cell Nos. 1 to 7 );

Pattern 2: 11 points from the position "+5" to the position "−5" (cell Nos. 8 to 18);

Pattern 3: 15 points from the position "−7" to the, position "+7" (cell Nos. 19 to 33);

Pattern 4: 19 points from the position "+9" to the position "−9" (cell Nos. 34 to 52);

Pattern 5: 23 points from the position "−11" to the position "+11" (cell Nos. 53 to 75);

Pattern 6: 25 points from the position "+12" to the position "−12" (cell Nos. 76 to 100);

Pattern 7: 21 points from the position "−10" to the position "+10" (cell Nos. 101 to 121);

Pattern 8: 17 points from the position "+8" to the position "−8" (cell Nos. 122 to 138);

Pattern 9: 13 points from the position "−6" to the position "+6" (cell Nos. 139 to 151); and Pattern 10: 9 points from the position "+4" to the position "−4" (cell Nos. 152 to 160).

The drive control device 48 performs the patterns 1 to 10 (cell Nos. 1 to 160) in turn. When the pattern 10 is performed, the drive control device 48 returns to the pattern 1 and repeats the process from the pattern 1 to the pattern 10.

For example, when a total of 32,000 sheets is printed while shifting the reference position 24 in accordance with the above-described shift pattern each time 200 sheets pass the fixing device, 200 sheets pass each position (cell) of each pattern. FIG. 7B illustrates the number of stop operations and the number of printed sheets at each of the positions "−12" to "+12". Specifically, 400 sheets pass each of the positions "−11" and "+11", 600 sheets pass each of the positions "−10" and "+10", 800 sheets pass each of the positions "−9" and "+9", 1,000 sheets pass each of the positions "−8" and "+8", 1,200 sheets-pass each of the positions "−7" and "+7", 1,400 sheets pass each of the positions "−6" and "+6", 1,600 sheets pass each of the positions "−5" and "+5", 1,800 sheets pass each of the positions "−4" and "+4", and 2,000 sheets pass each of the positions "−3" and "+3".

In this example, the shift from one cell to another cell is carried out each time a certain number of sheets passes. However, it is to be noted that, alternatively, the shift operation may be repeated, for example, at a certain time interval.

In FIG. 7B, the shift amount between adjacent points (minimum shift unit) is set to 0.0847 mm, which corresponds to 300 dpi, a resolution of the sheet detector 17 in this example. It may be preferable that the minimum shift unit is smaller. However, since the degree of shift accuracy in this example is substantially ±0.1 mm and setting the shift amount to a value smaller than 0.0847 mm may be an excessive specification in terms of the degree of shift accuracy, the shift amount is set to 0.0847 mm as described above. In other words, since the shift amount of the shift unit 40 varies in a range of ±0.1 mm, the minimum shift amount is set to 0.0847 mm in this example.

When the shift amount is set to 0.0847 mm, the maximum shift amount of the shift unit 40 is ±1.016 mm (0.0847 mm×12 dots) at the pattern 6. Although a larger maximum shift amount may be preferable in terms of prevention of wear on the fixing device, the maximum shift amount in this example is set to ±1 mm taking mechanical limitations into account. Since the movable range of the shift unit 40 is ±5 mm, ±4 mm is allocated to correction for a sheet-feed displacement and the remaining ±1 mm is used for cyclical shift.

In this example, the maximum number of steps of the shift unit 40 is 25 (from the positions "−12" to "+12" including the position "0"). Taking into account the total number of sheets passed (for example, 32,000 sheets), the degree of wear on the fixing member, and the degree of fixing failure together, the total number of 10 patterns is selected so that a worn portion of the fixing member is formed in a substantially trapezoidal shape. In this regard, the total number of patterns and the number of shifts can be varied.

Further, in this example, a position-information storage device is provided to store a shift position-of the reference position 24 in a shift pattern, a number code of the shift pattern, and the number of sheets printed at the shift position. In such a case, when a driving power source, not shown, is turned on, the reference position 24 is determined based on the position information. For example, when the power is turned off at the position "+2" (cell No. 28) in the shift pattern 3 and then turned on again, the shift of the reference position 24 is restarted from the cell No. 28. Thus, even when the power is turned off and then on again, the degree of wear on a fixing member can be continuously managed, effectively increasing the service life of the fixing member.

Figure 8:
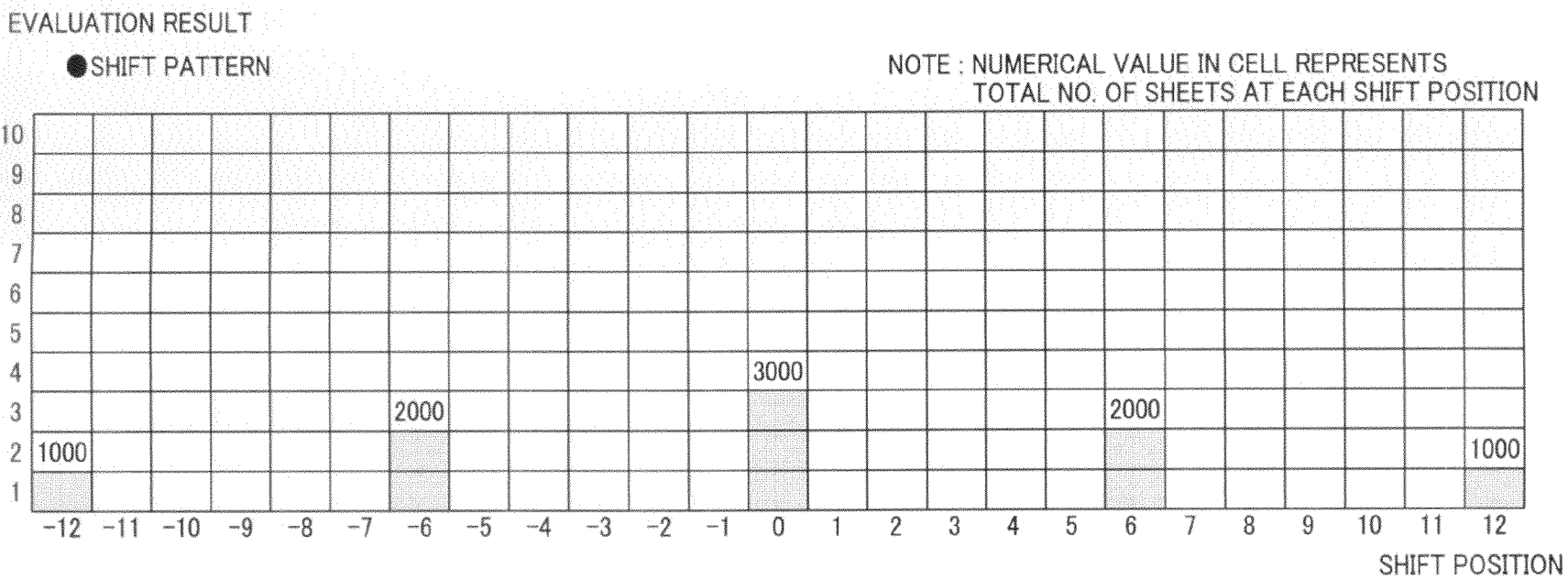
FIG. 8 is a graph showing results of a test conducted to evaluate the effectiveness of various shift patterns.

FIG. 8 is a graph showing results of a test that the inventor performed to evaluate the effectiveness of the shift patterns, in which the total number of sheets was set to 9,000, the total number of patterns was set to three, and the number of sheets passing each cell was set to 200. When the evaluation test was performed under the above-described conditions, no fixing failure was found and image formation performance was excellent. The boundary between a worn portion and an unworn portion is less remarkable, a narrow-edge portion of the worn portion of a substantially trapezoidal shape is less worn, and no remarkable step arises between a narrow edge and each oblique edge of the substantially-trapezoidal worn portion, preventing uneven fixing of an image on the sheet.

Figure 9A:
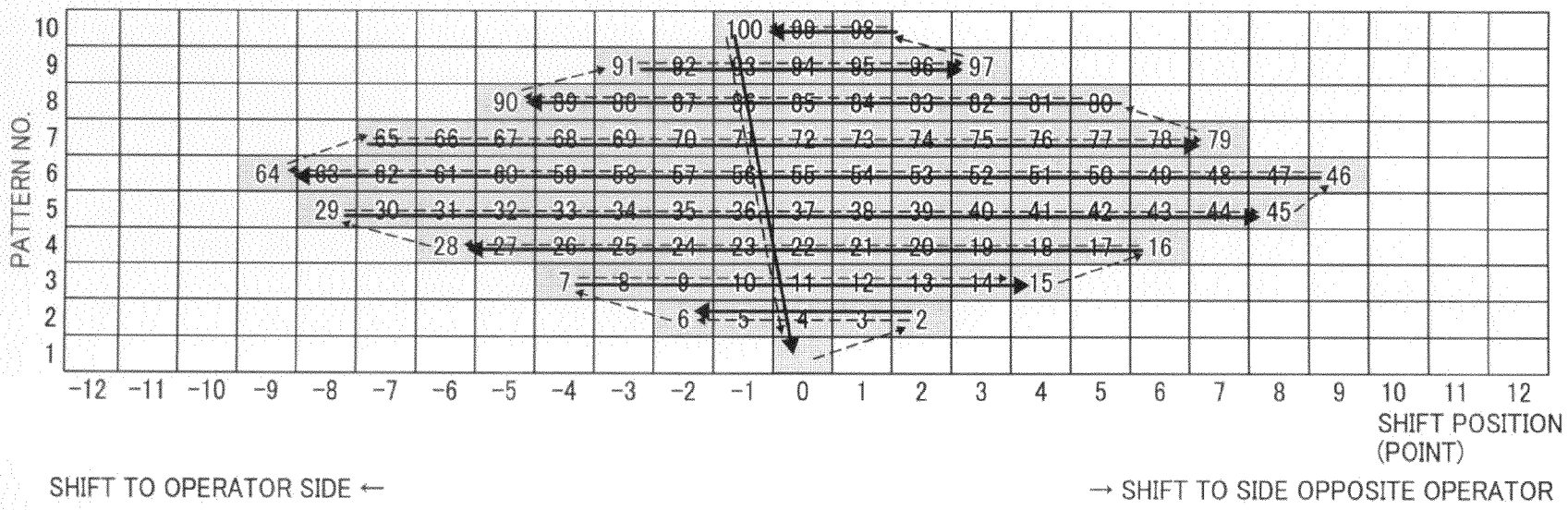
FIG. 9A is a schematic diagram illustrating the second shift pattern illustrated in FIG. 5.
Figure 9B:
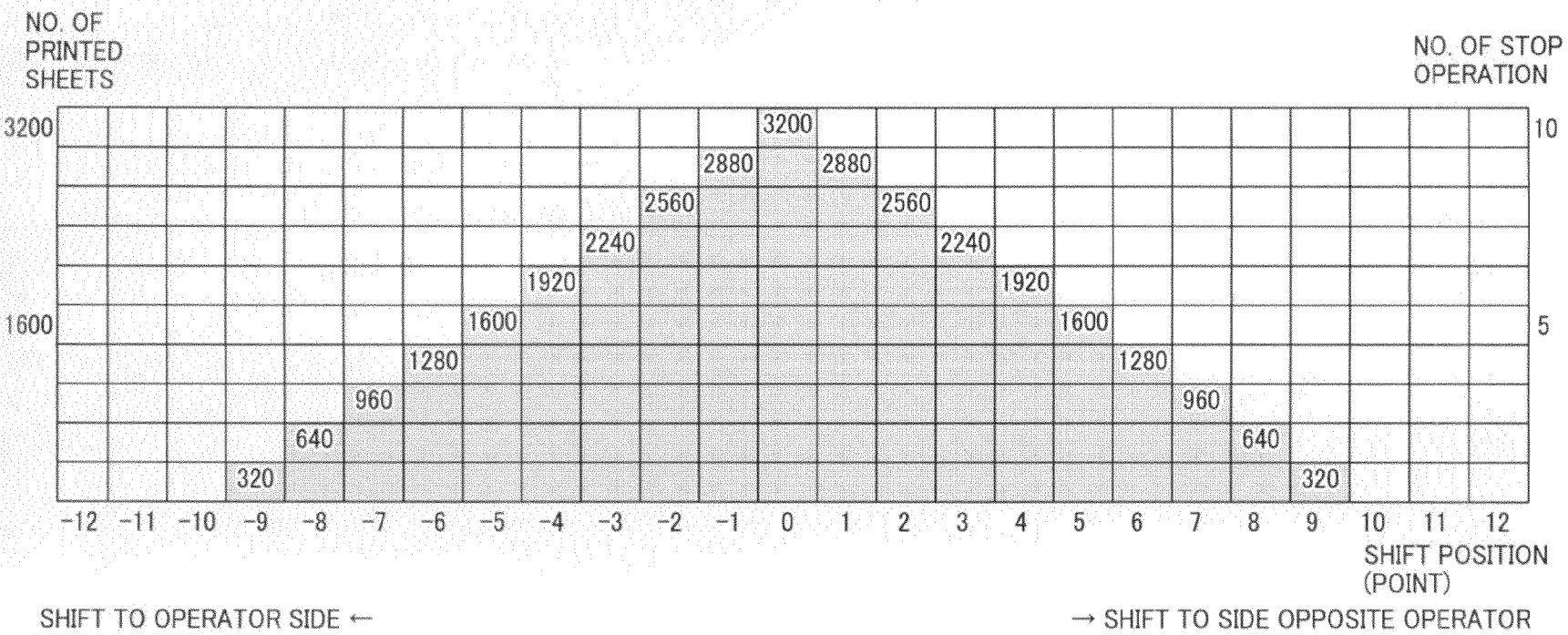
FIG. 9B is a schematic diagram illustrating the number of printed sheets at each shift position.

Next, a second-shift pattern is described, in which a worn portion of a substantially-triangle shape as illustrated in FIG. 5(*b*) is formed. FIGS. 9A and 9B illustrate the second shift pattern. FIG. 9A is a graph illustrating the second shift pattern, and FIG. 9B is a graph illustrating the number of printed sheets at each shift position.

The second shift pattern includes a set of 10 patterns (Patterns 1 to 10). In the shift pattern, from a neutral position "b" of the reference position 24, the reference position 24 is shifted in the positive and negative directions according to, for example, the following patterns 1 to 10.

Pattern 1: one point of the position "0" (cell No. 1);

Pattern 2: 5 points from the position "+2" to the position "−2" (cell Nos. 2 to 6);

Pattern 3: 9 points from the position "−4" to the position "+4" (cell Nos. 7 to 15);

Pattern 4: 13 points from the position "+6" to the position "−6" (cell Nos. 16 to 28);

Pattern 5: 17 points from the position "−8" to the position "+8" (cell Nos. 29 to 45);

Pattern 6: 19 points from the position "+9" to the position "−9" (cell Nos. 46 to 64);

Pattern 7: 15 points from the position "−7" to the position "+7" (cell Nos. 65 to 79);

Pattern 8: 11 points from the position,"+5" to the position "−5" (cell Nos. 80 to 90);

Pattern 9: 7 points from the position "−3" to the position "+3" (cell Nos. 91 to 97); and Pattern 10: 3 points from the position "+1" to the position "−1" (cell Nos. 98 to 100).

The drive control device 48 performs the patterns 1 to 10 (cell Nos. 1 to 100) in turn. When the pattern 10 is performed, the drive control device 48 returns to the pattern 1 and repeats the process from the pattern 1 to the pattern 10.

For example, when a total of 32,000 sheets is printed while shifting the reference position 24 in accordance with the above-described shift pattern each time 320 sheets pass the fixing device, 320 sheets pass each position (cell) of each pattern. FIG. 9B illustrates the number of stop operations and the number of printed sheets at each of the positions "−9" to "+9". Specifically, 320 sheets pass each of the positions "−9" and "+9", 640 sheets pass each of the positions "−8" and "+8", 960 sheets pass each of the positions "−7" and "+7", 1,280 sheets pass each of the positions "−6" and "+6", 1,600 sheets pass each of the positions "−5" and "+5", 1,920 sheets pass each of the positions "−4" and "+4", 2,240 sheets pass each of the positions "−3" and "+3", 2,560 sheets pass each of the positions "−2" and "+2", 2,280 sheets pass each of the positions "−1" and "+1", and 3,200 sheets pass the position "0".

Thus, in this second shift pattern, the boundary between a worn portion and an unworn portion is less remarkable, preventing uneven fixing of an image on a sheet.

Figure 10A:
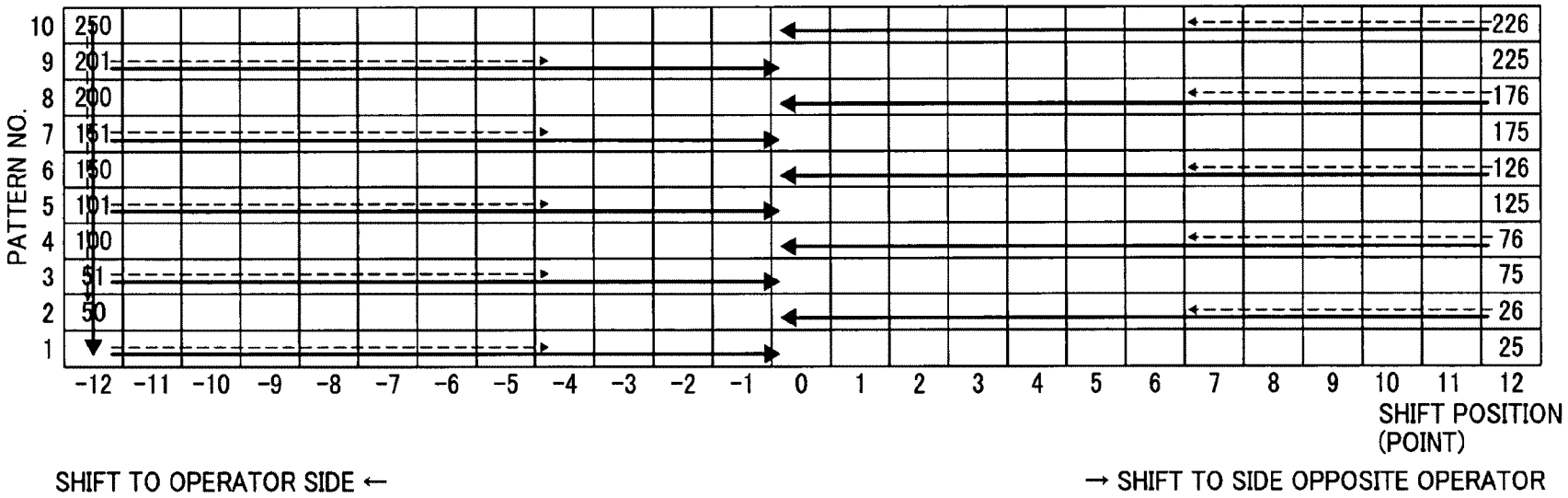
FIG. 10A is a schematic diagram illustrating the third shift pattern illustrated in FIG. 6.
Figure 10B:
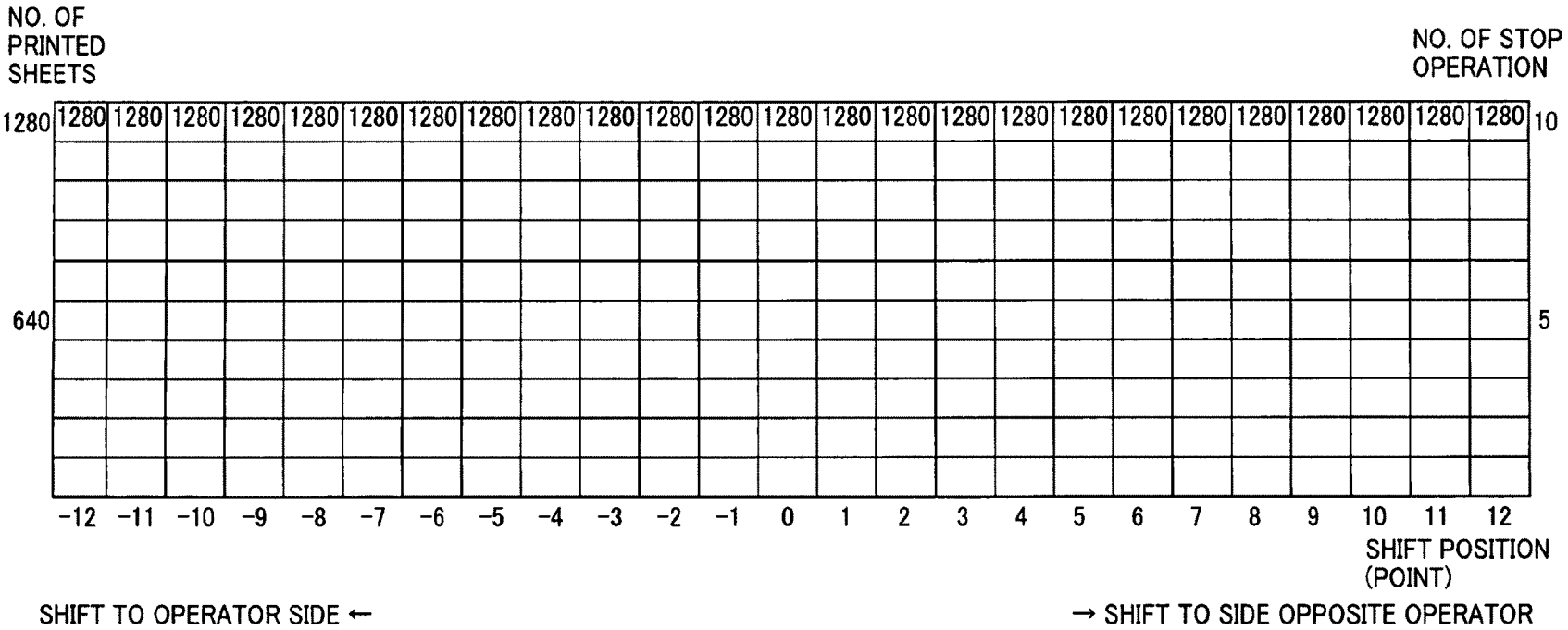
FIG. 10B is a schematic diagram illustrating the number of printed sheets at each shift position.
Figure 11:
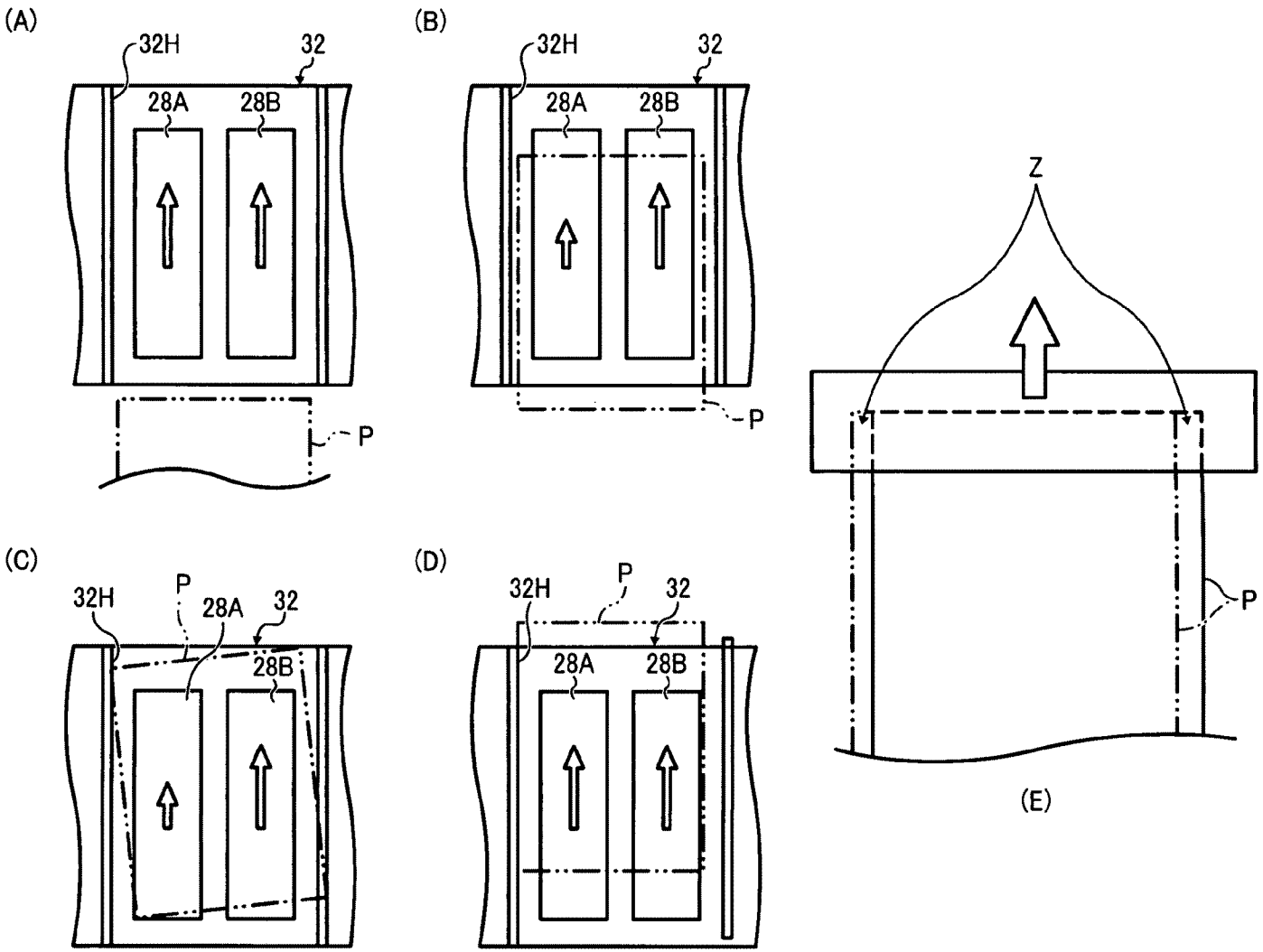
FIG. 11 RELATED ART
FIG. 11 is a schematic view illustrating an example of sheet conveyance in the related art.
Figure 12A:
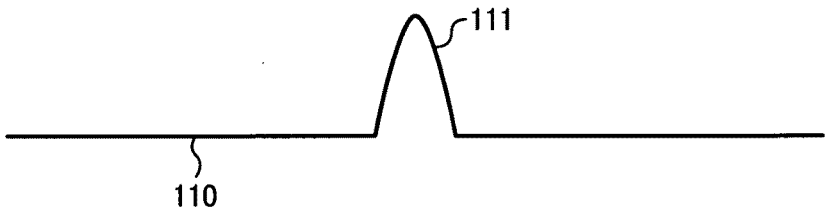
FIG. 12A RELATED ART
FIG. 12A is a schematic diagram illustrating an example of a worn state of a fixing member in the related art observed when a sheet passes once.
Figure 12B:
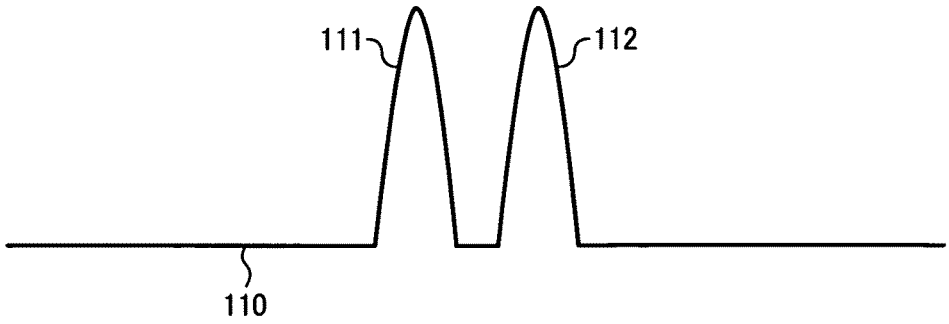
FIG. 12B RELATED ART
FIG. 12B is a schematic diagram illustrating a worn state of the fixing member observed when a number of sheets passes.

Next, a third shift pattern is described, in which a worn portion is formed in a substantially-rectangular shape as illustrated in FIG. 6(*b*). FIGS. 10A and 10B illustrate the third shift pattern. FIG. 10A is a graph illustrating the third shift pattern, and FIG. 10B is a graph illustrating the number of printed sheets at each shift position.

The third shift pattern includes a set of 10 patterns (Patterns 1 to 10). In the first shift pattern, from a neutral position "0"

of the reference position 24, the reference position 24 is shifted in the positive and negative directions according to, for example, the following patterns 1 to 10.

Pattern 1: 25 points from the position "−12" to the position "+12" (cell Nos. 1 to 25);

Pattern 2: 25 points from the position "+12" to the position "−12" (cell Nos. 26 to 50);

Pattern 3: 25 points from the position "−12" to the position "+12" (cell Nos. 51 to 75);

Pattern 4: 25 points from the position "+12" to the position "−12" (cell Nos. 76 to 100);

Pattern 5: 25 points from the position "−12" to the position "+12" (cell Nos. 101 to 125);

Pattern 6: 25 points from the position "+12" to the position "−12" (cell Nos. 126 to 150);

Pattern 7: 25 points from the position "−12" to the position "+12" (cell Nos. 151 to 175);

Pattern 8: 25 points from the position "+12" to the position "−12" (cell Nos. 176 to 200);

Pattern 9: 25 points from the position "−12" to the position "+12" (cell Nos. 201 to 225); and Pattern 10: 25 points from the position "+12" to the position "−12" (cell Nos. 226 to 250).

The drive control device 48 performs the patterns 1 to 10 (cell Nos. 1 to 250) in turn. When the pattern 10 is performed, the drive control device 48 returns to the pattern 1 and repeats the process from the pattern 1 to the pattern 10.

For example, when a total of 32,000 sheets is printed while shifting the reference position 24 to the above-described shift pattern each time 128 sheets pass the fixing device, 128 sheets pass each position (cell) of each pattern. As illustrated in FIG. 9B, the number of stop operations and the number of printed sheets at each of the positions "−12" to "+12" is 1,280.

Thus, in this third shift pattern, since the number of sheets passing the fixing member are dispersed among respective positions of the sheet-pass area, the wear amount of the respective positions are suppressed as a whole, preventing uneven fixing of an image on a sheet.

As described above, according to the illustrative embodiments of the present disclosure, the recording-medium positioning device 200 and the image forming apparatus 1000 can prevent a fixing member from being unevenly worn by edges of a recording medium. As a result, degradation in image quality at a certain position of the fixing member can be suppressed, allowing excellent image formation.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. A recording-medium positioning device, comprising:

a gate disposed at an upstream side of a fixing device in a conveyance direction of a recording medium on a conveyance path, the gate movable between an open position to allow the recording medium to pass and a closed position to position the recording medium by abutting the recording medium against the gate;

a roller pair including two roller members disposed at an upstream side of the gate, the roller members sandwiching the recording medium on the conveyance path in a thickness direction of the recording medium, the roller members movable between a contact position to feed the recording medium and a separation position to separate from the recording medium;

a roller-pair shift unit to move the roller pair in accordance with a first position of the recording medium in the conveyance direction to shift the recording medium in a width direction of the recording medium perpendicular to the conveyance direction of the recording medium;

a recording-medium detector disposed between the fixing device and the gate, the recording-medium detector detecting a second position of the recording medium in the width direction of the recording medium;

a counting unit;

a drive control device operatively connected to the recording-medium positioning device and in communication with the recording medium detector, the drive control device configured to, move the recording medium to a first reference position by driving the roller-pair shift unit in accordance with the second position detected by the recording-medium detector, the drive control device cyclically shifting recording media from the first reference position to a plurality of successive reference positions in accordance with an instruction from an upper-level device, shift the recording media to one of said successive reference positions based on a shift pattern, the shift pattern having different shift widths, such that a maximum shift width is a width between extreme edges of the recording media relative to the fixing device, control a position of a next successive reference position based on the shift pattern, to shift the position of the next successive reference position each time the recording media are processed during a predetermined time period or each time a predetermined number of the recording media is processed, wherein each reference position has an associated accumulated number of the recording media, the counting unit configured to count totals of media processed at each reference position, and control so that a distribution of the accumulated number of the recording media at each reference position, based on the totals of media processed at each reference position, when the predetermined time has passed or the predetermined number of recording media has been processed, decreases from a middle portion toward a portion closer to an edge of the maximum shift width, wherein the reference position is shifted in accordance with a first shift pattern in which the shift width of the reference position is gradually reduced to a certain width or in accordance with a second shift pattern in which the shift width of the reference position is gradually reduced, and the number of times an edge portion of the recording medium passes a given area decreases at a portion closer to an edge of the given area compared to a middle portion of the given area.

2. The recording-medium positioning device according to claim 1, wherein the drive control device shifts the recording media to the first reference position or to one of the plurality of successive reference positions, across a width dimension of the recording media using a unit of shift amount substantially equal to a distance corresponding to a resolution of the recording-medium detector.

3. The recording-medium positioning device according to claim 2, wherein, in each of a plurality of successive shift patterns, an order of the successive reference positions is determined, and the drive control device cyclically shifts the successive reference positions from one shift position to another shift position.

4. The recording-medium positioning device according to claim 3, wherein the drive control device executes the plurality of successive shift patterns in a desired order.

5. The recording-medium positioning device according to claim 4, wherein, when the plurality of successive shift patterns are executed in succession, a shift direction of each of the successive reference positions is inverted each time a successive shift pattern is executed.

6. The recording-medium positioning device according to claim 5, wherein the plurality of successive shift patterns are cyclically executed.

7. An image forming apparatus comprising:

a fixing device disposed on a conveyance path of a recording medium to fix an image on the recording medium; and a recording-medium positioning device disposed at an upstream side of the fixing device in a conveyance direction of the recording medium on the conveyance path, the recording-medium positioning device including, a gate disposed at the upstream side of the fixing device in the conveyance direction of the recording medium on the conveyance path, the gate movable between an open position to allow the recording medium to pass and a closed position to position the recording medium by abutting the recording medium against the gate;

a roller pair including two roller members disposed at an upstream side of the gate, the roller members sandwiching the recording medium on the conveyance path in a thickness direction of the recording medium, the roller members movable between a contact position to feed the recording medium and a separation position to separate from the recording medium;

a roller-pair shift unit to move the roller pair in accordance with a first position of the recording medium in the conveyance direction to shift the recording medium in a width direction of the recording medium perpendicular to the conveyance direction of the recording medium;

a recording-medium detector disposed between the fixing device and the gate, the recording-medium detector detecting a second position of the recording medium in the width direction of the recording medium;

a counting unit; and a drive control device operatively connected to the recording-medium positioning device, and in communication with the recording medium detector, the drive control device configured to, move the recording medium to a first reference position by driving the roller-pair shift unit in accordance with the second position detected by the recording-medium detector, the drive control device cyclically shifting recording media from the first reference position to a plurality of successive reference positions in accordance with an instruction from an upper-level device, shift the recording media to one of said successive reference positions based on a shift pattern, the shift pattern having different shift widths, such that a maximum shift width is a width between extreme edges of the recording media relative to the fixing device, control a position of a next successive reference position based on the shift pattern, to shift the position of the next successive reference position each time the recording media are processed during a predetermined time period or each time a predetermined number of the recording media is processed, wherein each reference position has an associated accumulated number of the recording media, the counting unit configured to count totals of media processed at each reference position, and the drive control device further configured to, and control so that a distribution of the accumulated number of the recording media at each reference position, based on the totals of media processed at each reference position, when the predetermined time has passed or the predetermined number of recording media has been processed, decreases from a middle portion toward a portion closer to an edge of the maximum shift width, wherein the reference position is shifted in accordance with a first shift pattern in which the shift width of the reference position is gradually reduced to a certain width or in accordance with a second shift pattern in which the shift width of the reference position is gradually reduced, and the number of times an edge portion of the recording medium passes a given area decreases at a portion closer to an edge of the given area compared to a middle portion of the given area.

8. The recording-medium positioning device according to claim 1 wherein selected portion of the maximum shift width corresponds to a middle of the fixing device in a direction perpendicular to the conveyance direction.

9. The image forming apparatus of claim 7, wherein a selected portion of the maximum shift width corresponds to a middle of the fixing device in a direction perpendicular to the conveyance direction.

* * * * *